United States Patent [19]

Reindel

[11] 4,110,715

[45] Aug. 29, 1978

[54] BROADBAND HIGH PASS MICROWAVE FILTER

[75] Inventor: John Reindel, San Diego, Calif.

[73] Assignee: The United States of America as represented by the Secretary of the Navy, Washington, D.C.

[21] Appl. No.: 819,637

[22] Filed: Jul. 27, 1977

[51] Int. Cl.[2] ..... H01P 1/20

[52] U.S. Cl. ..... 333/73 S; 333/73 C

[58] Field of Search ..... 333/10, 73 R, 73 C, 333/73 S, 73 W

[56] References Cited

U.S. PATENT DOCUMENTS

| | | | |
|---|---|---|---|
| 2,014,524 | 9/1935 | Franz | 333/73 S |
| 2,014,524 | 9/1935 | Franz | 333/73 S |
| 2,915,716 | 12/1959 | Hattersley | 333/73 S |
| 2,922,968 | 1/1960 | Van Patten | 333/73 S |
| 3,345,589 | 10/1967 | Di Piazza | 333/73 R |
| 3,705,366 | 12/1972 | Vergnolle | 333/73 S |

*Primary Examiner*—Alfred E. Smith
*Assistant Examiner*—Harry Barlow
*Attorney, Agent, or Firm*—R. S. Sciascia; G. J. Rubens; H. Fendelman

[57] ABSTRACT

A broadband high pass microwave filter and method of manufacturing thereof that maximizes the frequency separation between the desired passband of the filter and spurious passbands. A strip of dielectric material has alternately spaced capacitor plates formed on both sides thereof such that parallel plate capacitors are formed at the overlapping sections of the capacitor plates. The dielectric strip is folded in accordian-like fashion and inductive leads are electrically connected to the capacitor plates at each of the folds. The folded dielectric strip is mounted on an MIC substrate, the end plates of the strip are electrically connected to microstrip conductors on the substrate and the inductive leads are connected to the ground plane of the microstrip substrate to thereby form the high pass microwave filter.

6 Claims, 6 Drawing Figures

BROADBAND HIGH PASS MICROWAVE FILTER

BACKGROUND OF THE INVENTION

The present invention relates generally to filter apparatus for filtering electrical signals to permit only those signals in a selected band to pass. More particularly, the invention pertains to the field of broadband high pass microwave filters.

Microwave filter designs are based on prototype lumped element low frequency circuits. Filter elements at low frequencies behave as almost pure capacitances and inductances. At higher frequencies the inductances of connecting wires and the capacitance of metal conductors change the effective reactances and must be considered in the filter design. At microwave frequencies the wavelength becomes so short that the designer either must miniaturize the circuit elements or build the circuits using known transmission line concepts and wave properties. Filters with very wideband performance, however, cannot use transmission line filter designs with line lengths greater than a fraction of a wavelength because the effective line lengths (reactances) change radically from opens to shorts, i.e. from inductances to capacitances, and cause spurious pass or stop bands.

High pass prototype filter circuits have the form shown in FIG. 1. By way of example, a nine-element filter is illustrated. It is understood, however, that filters may have fewer or more elements depending on the performance requirements. The prototype filter illustrated in FIG. 1 is comprised of the string of capacitors C1, C2, C3, C4, and C5 and further includes the inductances L1, L2, L3 and L4 connected between the capacitors and ground as illustrated. Conventional semi-lumped microwave high pass filters implement the FIG. 1 prototype by using small capacitive discs separated by inductive shunt elements formed by high impedance lines. Often the assembly is made by using split-block coaxial circuits. The high impedance line length can be estimated by using the approximation $$l = Lv/Z_o \quad (1)$$

where $L$ is the inductance of the prototype filter element, $v$ is the speed of light and $Z_o$ is the characteristic impedance of the wire, typically 150 to 200 ohms.

Another method often used to implement the prototype filter of FIG. 1 forms the capacitors by overlapping strip lines separated by dielectric blocks with the inductors formed by connecting strip lines between the overlapping capacitor sections. This technique, however, is useful only for a limited bandwidth because the total length of the capacitive assembly may be a significant fraction of a wavelength and because the capacitors and series connecting inductors also have parasitic capacitances to the ground plane.

SUMMARY OF THE INVENTION

The present invention relates to a high pass microcircuit filter that is operable over a very wide bandwidth, 0.5 to 20 GHz or greater. The invention utilizes a novel method of fabricating a set of cascaded precision capacitors with values in the picofarad range and below. The invention is particularly suitable for implementation of the prototype filter network illustrated in FIG. 1. It is to be understood, however, that other filter designs may be achieved in accordance with the teachings of the present invention herein.

The novel construction technique of the present invention is such that the capacitors of the filter are preassembled in a very compact package with a high degree of accuracy and with printed circuit techniques known to provide reproducibility and low cost. The assembly has very low parasitic reactances and can be considered to be essentially lumped at frequencies up to 20 GHz. The fabrication technique of the present invention, moreover, lends itself to preproduction and commercial distribution of filter assemblies for hybrid microwave circuits in a variety of MIC systems. Additionally, the filter assembly disclosed herein can be attached to a microstrip circuit much the same way that a transistor or diode is attached to a hybrid circuit.

STATEMENT OF THE OBJECTS OF THE INVENTION

It is the primary object of the present invention to disclose a novel high pass filter that is useful over extremely wide bandwidths.

It is a further object of the present invention to disclose a novel technique for fabricating high pass filter elements consisting of series capacitors on flexible printed circuit dielectric materials and parallel inductors formed from simple wires, that when assembled are extremely small and have very low values of parasitic reactances.

It is another object of the present invention to disclose a broadband high pass microwave filter that maximizes the frequency separation between the desired passband and spurious passbands.

Another object of the present invention is to disclose a novel technique for fabricating filter elements that is relatively simple, offers a high degree of accuracy, is suitable for mass production and is inexpensive.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
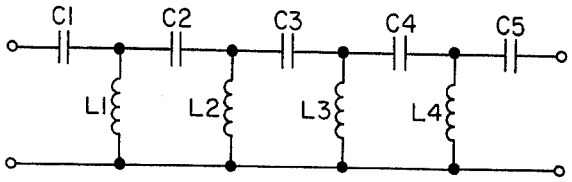
Fig. 1 (PRIOR ART)
FIG. 1 is a network schematic diagram of a prior art high pass filter prototype.

The present invention is a microcircuit wideband high pass filter having an equivalent circuit of the type illustrated in FIG. 1. The filter in accordance with the present invention uses semi-lumped capacitive and inductive elements in an ultra small and compact assembly that renders it useful at very high frequencies. The invention will be described with respect to the capacitive elements C1 through C5 and inductive elements L1 through L4 illustrated in the prototype filter of FIG. 1. It is to be understood, however, that other filter designs may be accomplished in accordance with the present teachings and that the illustrated embodiments are intended to be exemplary only.

Figure 2:
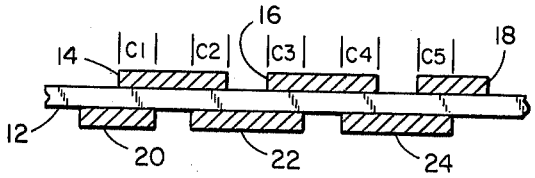
FIG. 2 is an edge view of an initial construction stage of the present invention illustrating the elements forming the capacitors of the filter.
Figure 3:
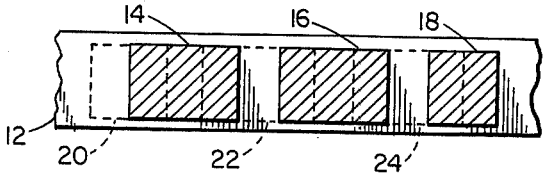
FIG. 3 is a top view of the components illustrated in FIG. 2.

Referring now to FIGS. 2 and 3 there is illustrated a thin, narrow dielectric material 12 which may initially comprise a very thin copper clad dielectric laminate. Where a copper clad laminate is used, the capacitor plates 14, 16, and 18 are formed on a first side thereof and the capacitor plates 20, 22, and 24 are formed on the reverse side of the dielectric material 12 in a staggered arrangement. These capacitor plates may be formed by any suitable means such as, for example, any photolithographic process for removing the metal cladding from the dielectric. As indicated in FIGS. 2 and 3, the capacitor plates 14 and 20 are spaced such that each overlaps a portion of the other. This overlapping portion of capacitor plates 14 and 20 forms a parallel plate capacitor and is illustrated as forming the capacitor C1 to indicate that this capacitance corresponds to the capacitor C1 illustrated in the prototype filter of FIG. 1. Similarly, capacitor plate 14 overlaps capacitor plate 22 on the reverse side of dielectric strip 12 to form another capacitor in the overlapping region thereof illustrated in this exemplary embodiment as corresponding to the capacitor plate C2 in the prototype filter of FIG. 1. Likewise, capacitor plate 16 overlaps portions of both the capacitor plates 22 and 24 and capacitor plate 18 overlaps the other end portion of capacitor plate 24 to form the counterparts to capacitors C3, C4, and C5 of the prototype filter illustrated in FIG. 1. The capacitance of each element is determined by the width of each of the capacitor plates, the dielectric constant of the strip 12, the width of the overlap as well as the thickness of the dielectric strip 12 which may, for example, be in the range of 0.003 to 0.010 inches. Although the capacitor plates 14, 16, and 18 as well as the capacitor plates 20, 22, and 24 are illustrated as having equal spacings therebetween as well as an equal amount of overlap between the corresponding capacitor plates, it is to be understood that different filter designs may be achieved by varying the spacings between the capacitor plates on the same side of the strip 12 as well as by varying the amount of overlap between capacitor plates on opposite sides of the strip 12.

Figure 4:
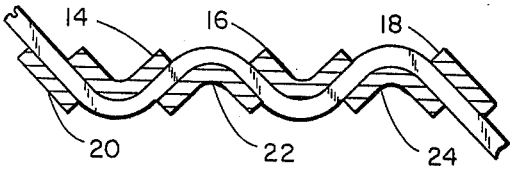
FIG. 4 is an edge view of the components of FIG. 2 illustrating the compression technique of the present invention.

Referring now to FIG. 4, the next step in the manufacturing process is illustrated whereby the array of capacitors is compacted by folding strip 12 in accordian-like manner as shown such that each of the intermediate capacitor plates 14, 16, 22, and 24 is also folded.

Figure 5:
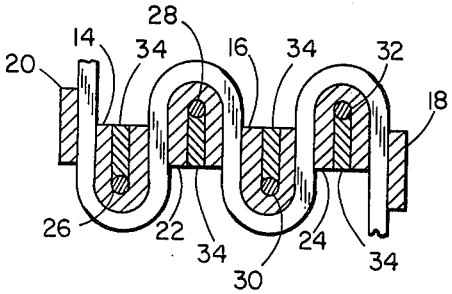
FIG. 5 is a further illustration of the components of the present invention illustrated in FIGS. 2, 3 and 4 further compacted in accordance with the present invention and also illustrating the inductive wires attached to the capacitor plates.
Figure 6:
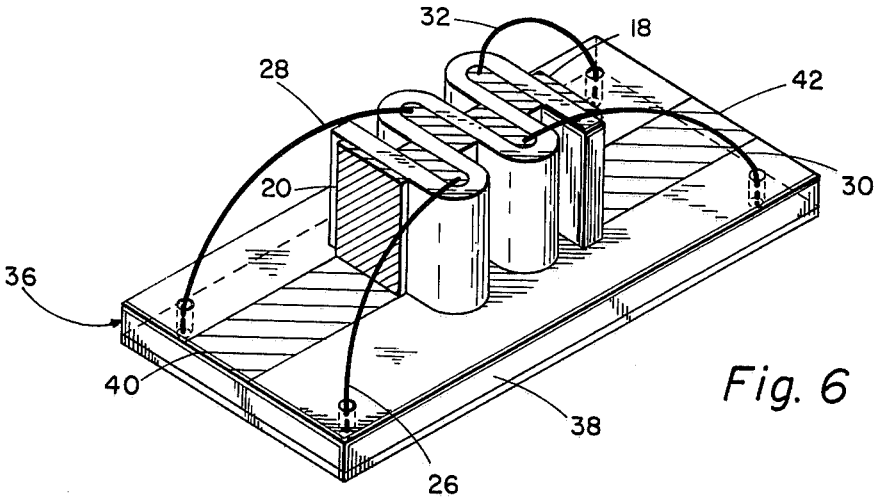
FIG. 6 is a perspective view of the fully assembled high pass filter of the present invention mounted on an MIC substrate.

The next step in the process is to solder the wires 26, 28, 30 and 32 in the corners of the folds as illustrated in FIG. 5. The wires 26, 28, 30, and 32 thus correspond to the inductors L1, L2, L3, and L4 illustrated in the equivalent circuit prototype of FIG. 1. The assembly is then heated, further compacted and maintained in this compacted state as by soldering the folded halves of each of the intermediate capacitor plates 14, 16, 22 and 24 together with suitable solder material 34. This package now contains all the filter capacitors and shunt inductors illustrated in the prototype of FIG. 1.

The package is next turned on its edge and mounted on a microcircuit such as the MIC substrate 36. The substrate 36 includes a ground plane on the underside thereof (not shown), a dielectric 38 such as, for example, Teflon impregnated fiber board, and microstrip conductors 40 and 42 which form the input and output lines. The package is attached to the microcircuit 36 by suitable means such as soldering the outside capacitor plates 18 and 20 to the microstrip lines 40 and 42. The inductor 26, 28, 30 and 32 are connected to the ground plane by suitable means as, for example, by extending them through holes drilled in the board 38 as illustrated or by bringing them around the outer edges of the board 38 and connecting them as by soldering to the ground plane. The length of the inductive wires 26, 28, 30, and 32 may be determined from the approximation in equation (1).

The overall size of this assembly can be held to a maximum dimension of approximately 0.04 inches while the element values for filters can be realized with frequencies as low as a few hundred MHz. Filters can thus be constructed in accordance with the present invention having passbands extending to greater than 30 times their cutoff frequencies. It can thus be appreciated that a prototype filter design has been disclosed in which the reactive components are maximally lumped, i.e. the distributed nature of the elements is minimized. Due to the compacted nature of the filter produced by the novel manufacturing technique, prototype filters can be realized which maximize the frequency separation between the desired passbands of the filter and the spurious passbands inherent in filters of this type.

Obviously many other modifications and variations of the present invention are possible in the light of the above teachings. It is therefore to be understood that within the scope of the appended claims the invention may be practiced otherwise than as specifically described.

What is claimed is:

1. A broadband high pass microwave filter comprising:

a thin strip of dielectric material having first and second surfaces on opposite sides thereof;

a first series of spaced metallic capacitor plates disposed on said first surface;

a second series of spaced metallic capacitor plates disposed on said second surface;

one plate of said first and second series of plates being a first end plate positioned at one end of said dielectric strip and another plate of said first and second series of plates being a second end plate positioned at the other end of said dielectric strip and all other plates being intermediate plates;

each intermediate plate of said first series of plates overlapping at least a portion of two adjacent plates of said second series of plates and each end plate overlapping at least a portion of one intermediate plate on the opposite side of said dielectric strip therefrom;

said dielectric strip being folded over and compressed in accordian-like fashion such that each intermediate plate is also folded over;

a plurality of electrical wires mechanically and electrically connected to selected ones of said intermediate plates; and a substrate on which said folded-over dielectric strip is supported.

2. The filter of claim 1 wherein said substrate is an MIC substrate supporting said dielectric strip on a first surface thereof and having a ground plane on a second surface thereof; and said substrate has an input MIC conductor disposed on said first substrate surface and operable coupled to said first end plate and an output MIC conductor disposed on said first substrate surface and operably coupled to said second end plate.

3. The filter of claim 2 wherein there is one of said plurality of electrical wires connected to each said intermediate plate and wherein each one of said plurality of electrical wires is also connected to said ground plane.

4. The filter of claim 3 wherein said dielectric strip is oriented on said substrate such that one of the edges of said dielectric strip is in abutting contact with said substrate.

5. The filter of claim 4 wherein each of said capacitor plates of said first series of plates is equally spaced apart and each of said capacitor plates of said second series of plates is equally spaced apart.

6. A method of making a high pass microwave filter so as to maximize the frequency separation between the desired passband of the microwave high pass filter and spurious passbands comprising the steps of:

(1) forming a first series of spaced metallic capacitor plates on a first side of a strip of dielectric material;

(2) forming a second series of spaced metallic capacitor plates on the opposing side of said strip of dielectric material such that two of said first and second series of plates are first and second end plates positioned at distal ends of said dielectric strip, such that all other plates are intermediate plates, such that each intermediate plate of said first series of plates overlaps a portion of two adjacent plates of said second series of plates and such that each of said two end plates overlaps one intermediate plate on the opposite side of said strip of dielectric material therefrom;

(3) operably coupling an electrical wire to each intermediate plate;

(4) minimizing the distribution of the capacitors formed by said plates by folding said dielectric strip in accordion-like fashion and maintaining said strip in said folded state;

(5) securing said folded strip to a MIC substrate;

(6) connecting said first and second end plates to input and output microstrip conductors on said MIC substrate; and (7) connecting said electrical wires to the ground plane of said MIC substrate.

* * * * *